US011022122B2

(12) United States Patent
Branch et al.

(10) Patent No.: US 11,022,122 B2
(45) Date of Patent: Jun. 1, 2021

(54) INTERMEDIATE DISCHARGE PORT FOR A COMPRESSOR

(71) Applicant: TRANE INTERNATIONAL INC., Davidson, NC (US)

(72) Inventors: Scott M. Branch, Tomah, WI (US); Timothy S. Hagen, Onalaska, WI (US); Jerry A. Rood, Onalaska, WI (US); Alberto Scala, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 23 days.

(21) Appl. No.: 15/611,137

(22) Filed: Jun. 1, 2017

(65) Prior Publication Data

US 2017/0350398 A1 Dec. 7, 2017

Related U.S. Application Data

(60) Provisional application No. 62/343,938, filed on Jun. 1, 2016.

(51) Int. Cl.
*F04C 29/12* (2006.01)
*F04C 18/16* (2006.01)
(Continued)

(52) U.S. Cl.
CPC ..... *F04C 29/12* (2013.01); *F04C 18/16* (2013.01); *F04C 27/00* (2013.01); *F25B 1/047* (2013.01);
(Continued)

(58) Field of Classification Search
CPC ..... F04C 18/16; F04C 14/26; F04C 27/00; F04C 28/10; F04C 29/12; F25B 1/047;
(Continued)

(56) References Cited

U.S. PATENT DOCUMENTS 4,388,048 A * 6/1983 Shaw ..... F04C 28/125 417/299
4,498,849 A * 2/1985 Schibbye ..... F04C 28/16 417/299
(Continued)

FOREIGN PATENT DOCUMENTS

CN 104047853 A 9/2014
DE 1217542 B 5/1966
(Continued)

OTHER PUBLICATIONS

Extended European Search Report, European Patent Application No. 17173981.6., dated Jul. 12, 2017, (7 pages).
(Continued)

*Primary Examiner* — Eric S Ruppert
*Assistant Examiner* — Hans R Weiland
(74) *Attorney, Agent, or Firm* — Hamre, Schumann, Mueller & Larson, P.C.

(57) ABSTRACT

A screw compressor includes a compressor housing defining a working chamber, the housing including a plurality of bores; a first rotor having helical threads, the first rotor being housed in a first of the plurality of bores; a second rotor having helical threads intermeshing with the helical threads of the first rotor, the second rotor being housed in a second of the plurality of bores; an inlet port that receives a fluid to be compressed; an outlet port that receives a compressed fluid; and an intermediate discharge port disposed between the compression chamber and the outlet port, the intermediate discharge port including a sealing member and a biasing mechanism, fluid flow being prevented between the compression chamber and the intermediate discharge port when in a flow-blocked state, and fluid flow being enabled from the compression chamber through the intermediate discharge port when in a flow-permitted state.

19 Claims, 7 Drawing Sheets

(51) Int. Cl.

| | |
|---|---|
| ***F25B 49/02*** | (2006.01) |
| ***F04C 28/10*** | (2006.01) |
| ***F04C 27/00*** | (2006.01) |
| ***F25B 1/047*** | (2006.01) |

(52) U.S. Cl.
CPC ..... *F25B 49/022* (2013.01); *F04C 28/10* (2013.01); *F25B 2600/027* (2013.01); *F25B 2600/0262* (2013.01)

(58) Field of Classification Search
CPC ..... F25B 49/022; F25B 2600/0262; F25B 2600/027; F25B 2600/0271; F25B 2700/1931
See application file for complete search history.

(56) References Cited

U.S. PATENT DOCUMENTS

| | | | | |
|---|---|---|---|---|
| 5,694,682 | A * | 12/1997 | Zuercher | F04C 28/125 29/888.023 |
| 6,135,744 | A * | 10/2000 | Andersen | F04C 28/125 418/201.2 |
| 6,461,119 | B1 * | 10/2002 | Timuska | F04C 28/16 251/63 |
| 7,214,036 | B2 * | 5/2007 | Yoshimura | F04C 18/084 417/252 |
| 2012/0027632 | A1 * | 2/2012 | Nemit, Jr. | F04C 18/16 417/440 |
| 2013/0139535 | A1 * | 6/2013 | Nares | F04B 49/00 62/228.1 |
| 2013/0216414 | A1 | 8/2013 | Kopko et al. | |
| 2014/0260414 | A1 | 9/2014 | Nemit, Jr. | |
| 2015/0093273 | A1 * | 4/2015 | Johnson | F04C 28/08 418/1 |
| 2018/0245595 | A1 * | 8/2018 | Mlsna | F25B 1/04 |

FOREIGN PATENT DOCUMENTS

| | | |
|---|---|---|
| EP | 0350426 | 1/1990 |
| GB | 384355 A | 12/1932 |
| WO | 2015/094466 | 6/2015 |

OTHER PUBLICATIONS

First Chinese Office Action, issued in the corresponding Chinese patent application No. 201710405287.X, dated Sep. 17, 2019, 17 pages (including machine translation).
European Examination Report; European Patent Application No. 17173981.6, dated Feb. 10, 2020 (6 pages).

* cited by examiner

INTERMEDIATE DISCHARGE PORT FOR A COMPRESSOR

FIELD

This disclosure relates generally to fluid discharge in a vapor compression system. More specifically, this disclosure relates to an intermediate discharge port of a compressor in a vapor compression system such as, but not limited to, a heating, ventilation, and air conditioning (HVAC) system.

BACKGROUND

One type of compressor for a vapor compression system is generally referred to as a screw compressor. A screw compressor generally includes one or more rotors (e.g., one or more rotary screws). Typically, a screw compressor includes a pair of rotors (e.g., two rotary screws) which rotate relative to each other to compress a working fluid such as, but not limited to, a refrigerant or the like.

SUMMARY

This disclosure relates generally to fluid discharge in a vapor compression system. More specifically, this disclosure relates to an intermediate discharge port of a compressor in a vapor compression system such as, but not limited to, a heating, ventilation, and air conditioning (HVAC) system.

In an embodiment, the compressor is a screw compressor. In an embodiment, the screw compressor can be used in an HVAC system (sometimes referred to alternatively as a refrigeration system) to compress a heat transfer fluid. The heat transfer fluid can be, for example, a refrigerant.

In an embodiment, the intermediate discharge port for the screw compressor can be included when the screw compressor is manufactured. In an embodiment, the intermediate discharge port for the screw compressor can be retrofit into the screw compressor that was manufactured without the intermediate discharge port. In an embodiment, the intermediate discharge port for the screw compressor can be retrofit into the screw compressor even after the screw compressor has been operated.

In an embodiment, the intermediate discharge port can be added to the screw compressor at a location that is in fluid communication with a compression chamber of the screw compressor. In an embodiment, the intermediate discharge port can be added to the screw compressor at a location that is disposed in fluid communication with a compression chamber of the screw compressor and is at a location between the inlet port and the outlet port of the compressor.

In an embodiment, a fluid flow state (e.g., flow-permitted, flow-blocked) of the intermediate discharge port of the screw compressor can be controlled based on a pressure differential. In an embodiment, the fluid flow state of the intermediate discharge port can be controlled by a biasing mechanism actuated in response to a signal from a controller.

A screw compressor is disclosed. In an embodiment, the screw compressor includes a compressor housing defining a working chamber, the housing including a plurality of bores; a first rotor having helical threads, the first rotor being housed in a first of the plurality of bores; a second rotor having helical threads intermeshing with the helical threads of the first rotor, the second rotor being housed in a second of the plurality of bores; an inlet port that receives a fluid to be compressed; an outlet port that receives a compressed fluid; and an intermediate discharge port disposed between the compression chamber and the outlet port, the intermediate discharge port including a sealing member and a biasing mechanism, fluid flow being prevented between the compression chamber and the intermediate discharge port when in a flow-blocked state, and fluid flow being enabled from the compression chamber through the intermediate discharge port when in a flow-permitted state.

An HVAC system is disclosed. In an embodiment, the HVAC system includes a condenser, an expansion device, and an evaporator, and a screw compressor fluidly connected and forming a heat transfer circuit. The screw compressor includes a compressor housing defining a working chamber, the housing including two bores; a first rotor having helical threads, the first rotor being housed in a first of the two bores; a second rotor having helical threads intermeshing with the helical threads of the first rotor, the second rotor being housed in a second of the two bores; a suction port that receives a fluid to be compressed; an outlet port that receives a compressed fluid; and an intermediate discharge port disposed between the compression chamber and the outlet port, the intermediate discharge port including a sealing member and a biasing mechanism, fluid flow being prevented between the compression chamber and the intermediate discharge port when in a flow-blocked state, and fluid flow being enabled from the compression chamber through the intermediate discharge port when in a flow-permitted state.

A method is disclosed. In an embodiment, the method includes providing an intermediate discharge port at a location in fluid communication with a compression chamber of a screw compressor, the intermediate discharge port being disposed between an inlet port and an outlet port of the screw compressor, wherein when operating the screw compressor at part-load, discharging a portion of a working fluid being compressed from the compression chamber toward a discharge of the screw compressor, the working fluid being at a pressure that is lower than a discharge pressure of the screw compressor, and when operating the screw compressor at full-load, discharging the working fluid being compressed from the outlet port of the screw compressor.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

This disclosure relates generally to fluid discharge in a vapor compression system. More specifically, this disclosure relates to an intermediate discharge port of a compressor in a vapor compression system such as, but not limited to, a heating, ventilation, and air conditioning (HVAC) system.

Generally, when a compressor is running at a part load operation, the compressor may over pressurize the working fluid. In an embodiment, an intermediate discharge port can be added to the compressor to allow the working fluid to leave the compression chamber prior to reaching the discharge port. In such an embodiment, the intermediate discharge port can increase an efficiency of the compressor by reducing the over pressurization of the working fluid. In an embodiment, an increase in efficiency can be at or about 12%. In an embodiment, an increase in efficiency can be up to 12% or up to about 12%. Unlike a slide valve, the intermediate discharge port is not determinative of a capacity of the screw compressor. Further, slide valves generally move in a direction that is parallel to the rotors of the screw compressor, while the intermediate discharge port generally moves in a direction that is about perpendicular to the rotors of the screw compressor.

Figure 1:
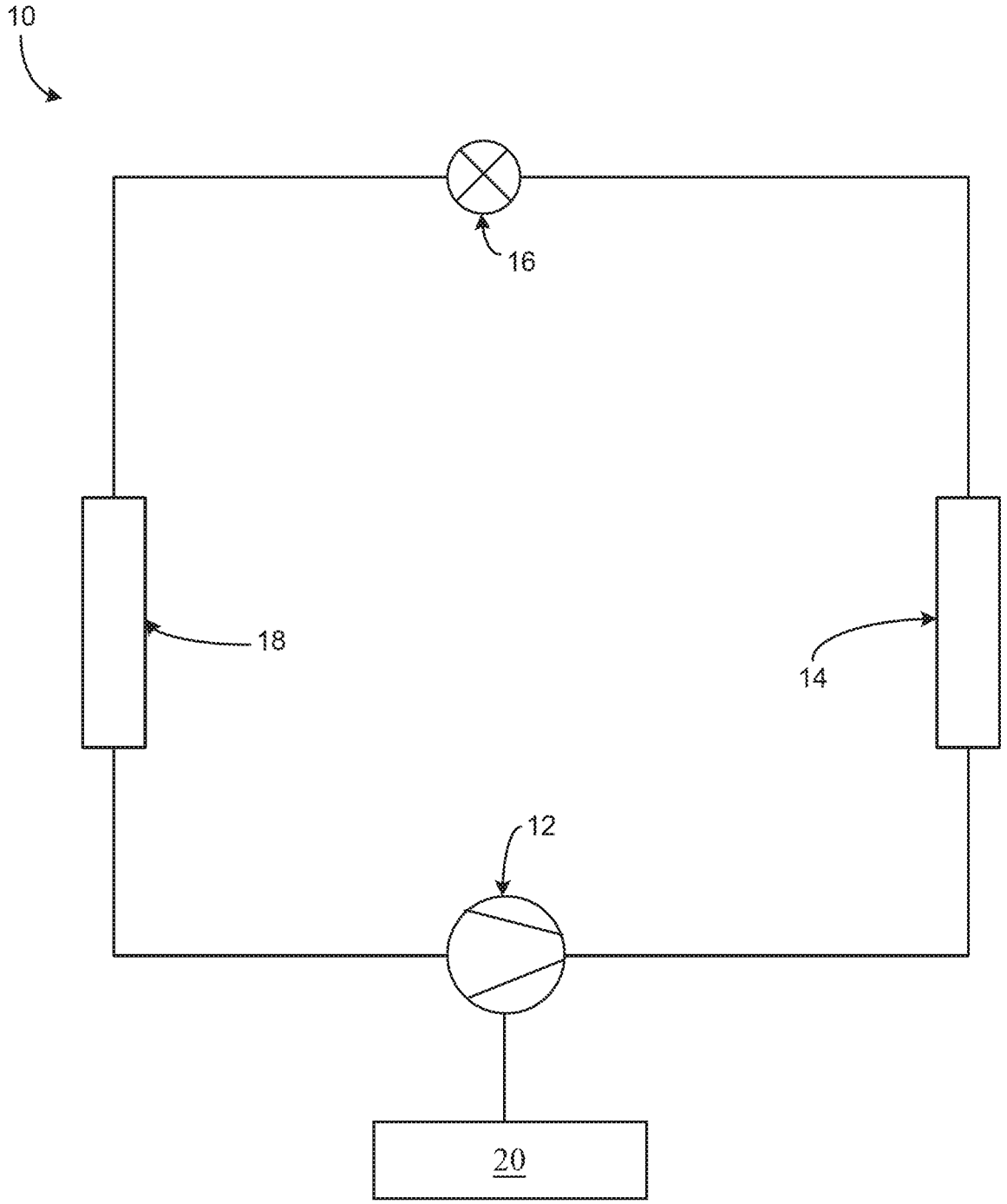
FIG. 1 is a schematic diagram of a heat transfer circuit with which embodiments of this disclosure can be practiced, according to an embodiment.

FIG. 1 is a schematic diagram of a heat transfer circuit 10, according to an embodiment. The heat transfer circuit 10 generally includes a compressor 12, a condenser 14, an expansion device 16, and an evaporator 18. The compressor 12 can be powered by an electric motor (not shown). The heat transfer circuit 10 is an example and can be modified to include additional components. For example, in an embodiment, the heat transfer circuit 10 can include an economizer heat exchanger, one or more flow control devices, a receiver tank, a dryer, a suction-liquid heat exchanger, or the like.

The heat transfer circuit 10 can generally be applied in a variety of systems (e.g., vapor compression systems) used to control an environmental condition (e.g., temperature, humidity, air quality, or the like) in a space (generally referred to as a conditioned space). Examples of systems include, but are not limited to HVAC systems, transport refrigeration systems, or the like.

The components of the heat transfer circuit 10 are fluidly connected. The heat transfer circuit 10 can be specifically configured to be a cooling system (e.g., a fluid chiller of an HVAC system and/or an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool a process fluid. In an embodiment, the process fluid can be, for example, a fluid such as, but not limited to, water or the like, in which case the heat transfer circuit 10 may be generally representative of a chiller system. In an embodiment, the process fluid can be, for example, a fluid such as, but not limited to, air or the like, in which case the heat transfer circuit 10 may be generally representative of an air conditioner or heat pump.

The compressor 12 is generally representative of a screw compressor. In operation, the compressor 12 compresses a working fluid (e.g., a heat transfer fluid such as refrigerant or the like) from a relatively lower pressure gas to a relatively higher-pressure gas. The relatively higher-pressure and higher temperature gas is discharged from the compressor 12 and flows through the condenser 14. In accordance with generally known principles, the working fluid flows through the condenser 14 and rejects heat to the process fluid (e.g., a heat transfer fluid or medium such as, but not limited to, water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from the process fluid (e.g., a heat transfer fluid or medium such as, but not limited to, water, air, etc.), heating the working fluid, and converting it to a gaseous form. The gaseous working fluid then returns to the compressor 12. The above-described process continues while the heat transfer circuit is operating, for example, in a cooling mode (e.g., while the compressor 12 is enabled).

In an embodiment, the compressor 12 can be controlled by, for example, a controller 20. The controller 20 can, in an embodiment, control one or more of the other components of the heat transfer circuit 10 or the HVAC system corresponding to the heat transfer circuit 10.

Figure 2:
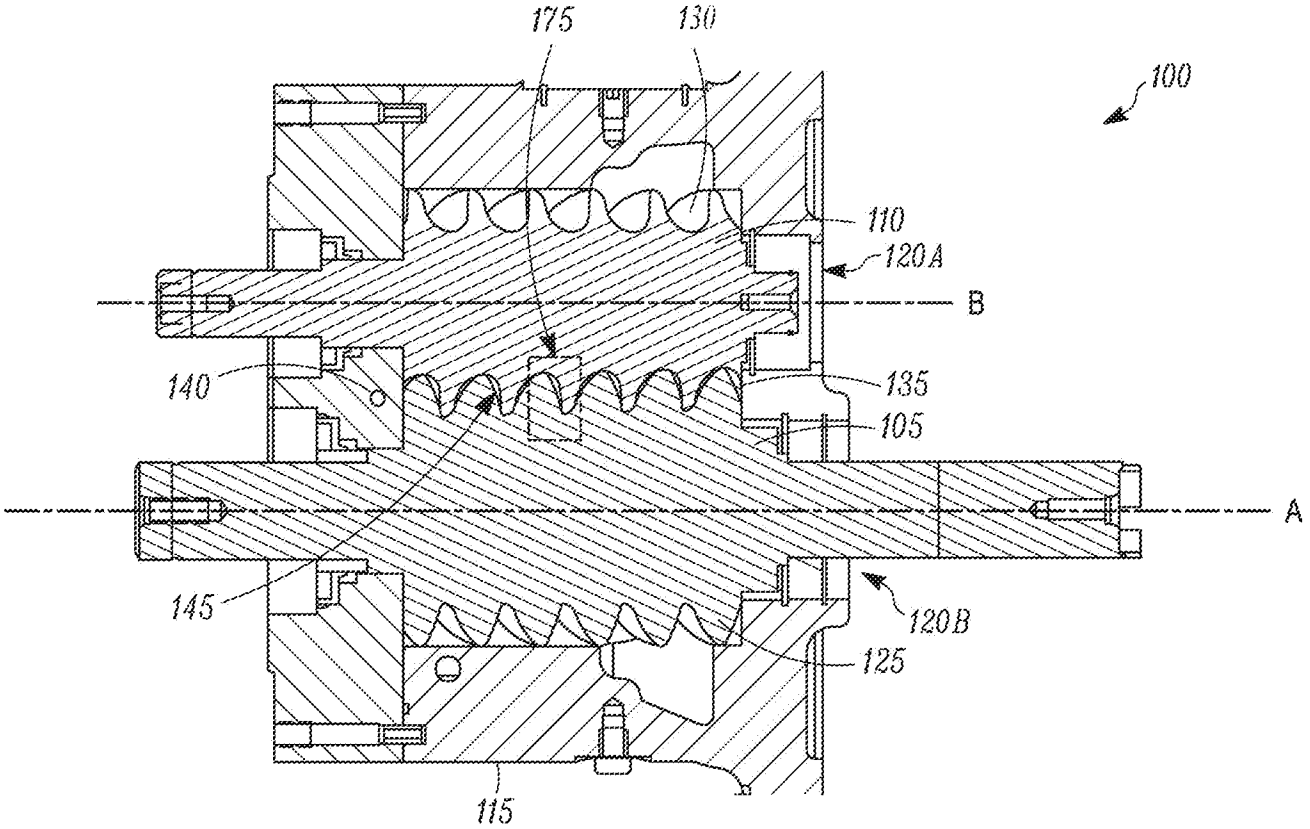
FIG. 2 illustrates a partial view of a screw compressor with which embodiments of this disclosure can be practiced, according to an embodiment.

FIG. 2 illustrates a screw compressor 100 with which embodiments as disclosed in this specification can be practiced, according to an embodiment. The screw compressor 100 can be used in the heat transfer circuit 10 of FIG. 1 (e.g., as the compressor 12). It is to be appreciated that the screw compressor 100 can be used for purposes other than in the heat transfer circuit 10. For example, the screw compressor 100 can be used to compress air or gases other than a heat transfer fluid (e.g., natural gas, etc.). It is to be appreciated that the screw compressor 100 includes additional features that are not described in detail in this specification. For example, the screw compressor 100 can include a lubricant sump for storing lubricant to be introduced to the moving features of the screw compressor 100.

The screw compressor 100 includes a first helical rotor 105 and a second helical rotor 110 disposed in a rotor housing 115. The rotor housing 115 includes a plurality of bores 120A and 120B. The plurality of bores 120A and 120B are configured to accept the first helical rotor 105 and the second helical rotor 110.

The first helical rotor 105, generally referred to as the male rotor, has a plurality of spiral lobes 125. The plurality of spiral lobes 125 of the first helical rotor 105 can be received by a plurality of spiral grooves 130 of the second helical rotor 110, generally referred to as the female rotor. In an embodiment, the spiral lobes 125 and the spiral grooves 130 can alternatively be referred to as the threads 125, 130. The first helical rotor 105 and the second helical rotor 110 are arranged within the housing 115 such that the spiral grooves 130 intermesh with the spiral lobes 125 of the first helical rotor 105.

During operation, the first and second helical rotors 105, 110 rotate counter to each other. That is, the first helical rotor 105 rotates about an axis A in a first direction while the second helical rotor 110 rotates about an axis B in a second direction that is opposite the first direction. Relative to an axial direction that is defined by the axis A of the first helical rotor 105, the screw compressor 100 includes an inlet port 135 and an outlet port 140.

The rotating first and second helical rotors 105, 110 can receive a working fluid (e.g., heat transfer fluid such as refrigerant or the like) at the inlet port 135. The working fluid can be compressed between the spiral lobes 125 and the spiral grooves 130 (in a pocket 145 formed therebetween) and discharged at the outlet port 140. The pocket is generally referred to as the compression chamber 145 and is defined between the spiral lobes 125 and the spiral grooves 130 and an interior surface of the housing 115. In an embodiment, the compression chamber 145 may move from the inlet port 135 to the outlet port 140 when the first and second helical rotors 105, 110 rotate. In an embodiment, the compression chamber 145 may continuously reduce in volume while moving from the inlet port 135 to the discharge port 145. This continuous reduction in volume can compress the working fluid (e.g., heat transfer fluid such as refrigerant or the like) in the compression chamber 145.

The screw compressor 100 can include an intermediate discharge port 175. The intermediate discharge port 175 can, for example, provide an exit flow path for the working fluid being compressed (e.g., heat transfer fluid such as refrigerant or the like). The intermediate discharge port 175 may alternatively be referred to as the radial discharge port 175, the radial intermediate discharge port 175, or the like. The intermediate discharge port 175 can, for example, enable the fluid being compressed to radially exit the compression chamber 145 prior to being discharged from the axial outlet port 140. The intermediate discharge port 175 can be oriented such that the fluid being compressed exits in a direction that is about perpendicular to the axial direction that is defined by the axis A of the first helical rotor 105 and the axis B of the second axial rotor 110.

Advantageously, according to an embodiment, the intermediate discharge port 175 can prevent overcompression of the working fluid by radially discharging the fluid from the compression chamber 145 prior to the outlet port 140. In an embodiment, preventing overcompression of the fluid can increase an efficiency of the screw compressor 100. In an embodiment, an increase in efficiency of the screw compressor 100 can be at or about 12%. In an embodiment, an increase in efficiency of the screw compressor 100 can be up to 12% or up to about 12%. The intermediate discharge port 175 is shown and described in additional detail according to various embodiments in accordance with FIGS. 3-6 below.

In an embodiment, the intermediate discharge port 175 can be included in the screw compressor 100 at a time of manufacturing. In an embodiment, the intermediate discharge port 175 can be retrofitted into the screw compressor 100 after manufacturing. In an embodiment, the intermediate discharge port 175 can be retrofitted into the screw compressor 100 even after the screw compressor 100 has been in use.

Figure 3:
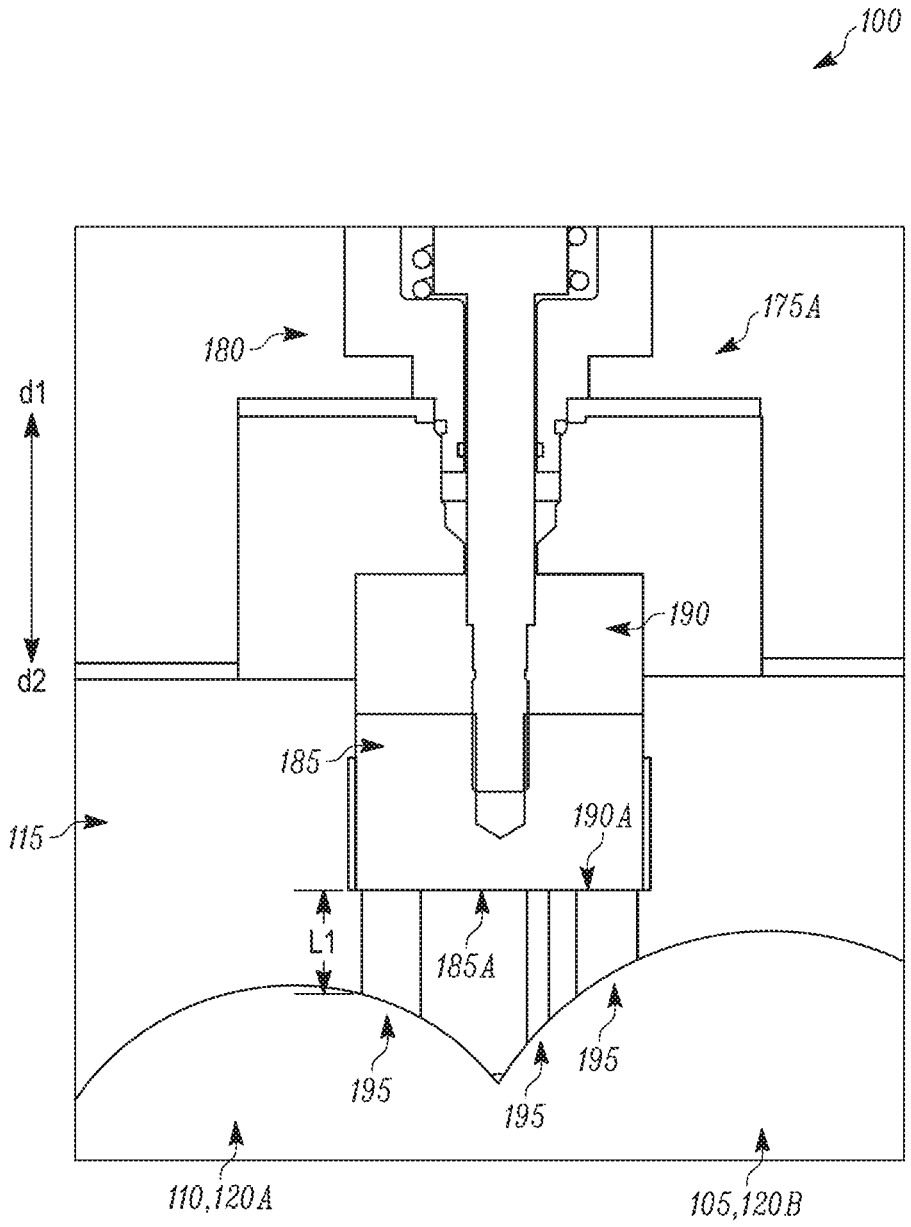
FIG. 3 illustrates a screw compressor including an intermediate discharge port in a flow-blocked state, according to an embodiment.
Figure 4:
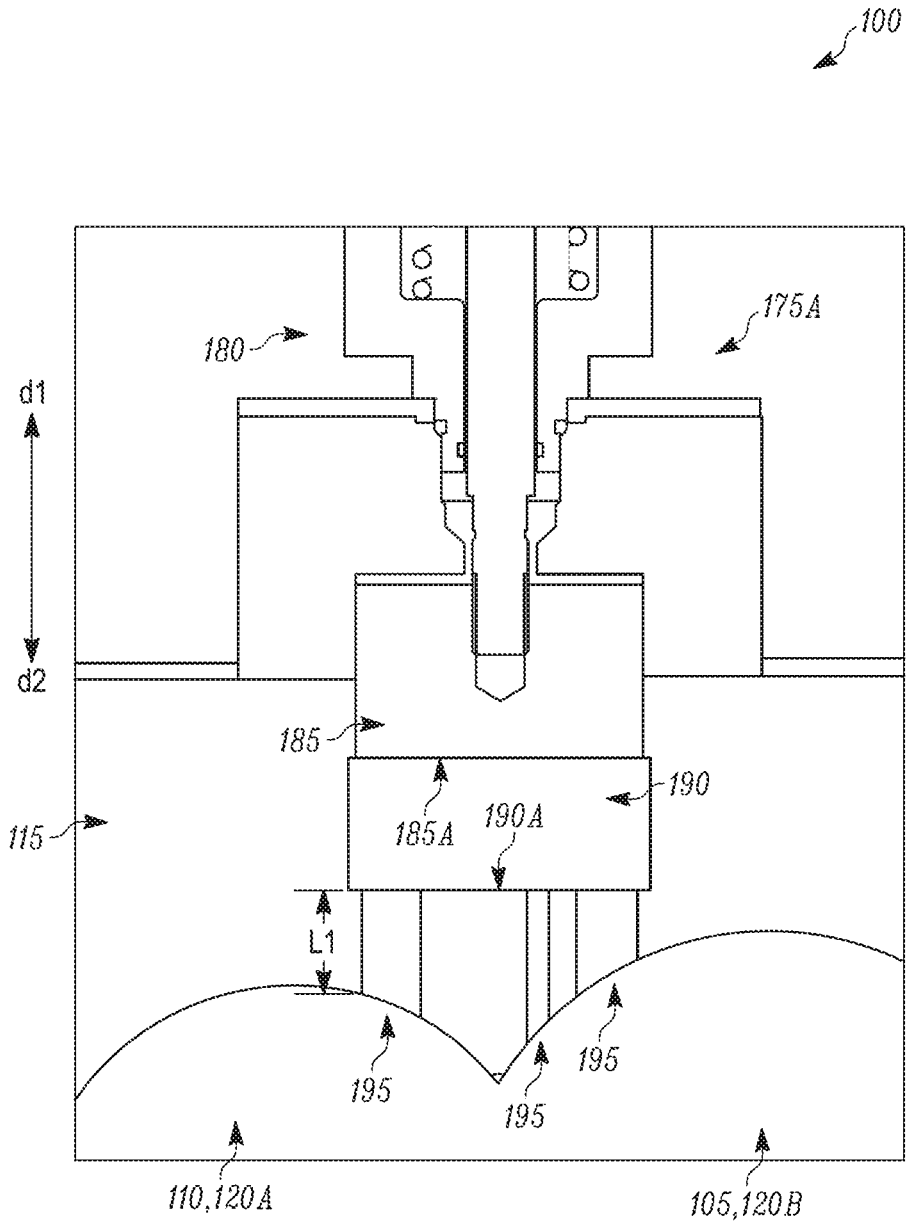
FIG. 4 illustrates the screw compressor including the intermediate discharge port of FIG. 3 in a flow-permitted state, according to an embodiment.

FIG. 3 illustrates the screw compressor 100 including an intermediate discharge port 175A, according to an embodiment. In FIG. 3, the intermediate discharge port 175A is in a flow-blocked (e.g., closed) state. FIG. 4 illustrates the screw compressor 100 including the intermediate discharge port 175A, according to an embodiment. In FIG. 4, the intermediate discharge port 175A is in a flow-permitted (e.g., opened) state. FIGS. 3-4 will be described generally, unless specific reference is made to the contrary.

In an embodiment, the screw compressor 100 can include a plurality of intermediate discharge ports 175A. For example, the screw compressor 100 can include a first intermediate discharge port at a first intermediate location and a second intermediate discharge port at a second intermediate location, with the first and second intermediate locations being selected to provide an intermediate discharge at a particular compressor load.

The intermediate discharge port 175A includes a biasing mechanism 180; a sealing member 185 connected to the biasing mechanism 180 and disposed within a chamber 190 of the intermediate discharge port 175A; and a plurality of apertures 195.

The biasing mechanism 180 can be an actively controlled mechanism, according to an embodiment. For example, the biasing mechanism 180 can be a biasing mechanism electrically connected to a controller (e.g., the controller 20 in FIG. 1). In such an embodiment, the controller can be connected to a sensor (e.g., a pressure sensor, etc.). The controller can provide an electric signal to the biasing mechanism 180 to control whether the biasing mechanism 180 is in the flow-blocked state (FIG. 3) or in the flow-permitted state (FIG. 4). For example, the controller might identify that the screw compressor 100 is operating at full capacity, in which case the controller might send a signal to the biasing mechanism 180 to place/maintain the biasing mechanism 180 in the flow-blocked state of FIG. 3. Alternatively, the controller might identify that the screw compressor 100 is operating at a capacity less than full capacity, in which case the controller might send a signal to the biasing mechanism 180 to place/maintain the biasing mechanism 180 in the flow-permitted state of FIG. 4.

In an embodiment, the biasing mechanism 180 can be a passively controlled mechanism. For example, the biasing mechanism 180 can be a biasing mechanism that is controllable between the flow-blocked (FIG. 3) and the flow-permitted (FIG. 4) states based on a pressure differential between the compression chamber 145 and the discharge. In such an embodiment, the intermediate discharge port 175A can alternate between the flow-blocked state (FIG. 3) and the flow-permitted state (FIG. 4) based on, for example, pressure differential of the discharge and the compression chamber 145. In such an embodiment, the intermediate discharge port 175A may be disposed at a top portion of the housing 115 such that the biasing mechanism moves vertically upward (e.g. with respect to the ground) or downward to transition between the flow-blocked state (FIG. 3) and the flow-permitted state (FIG. 4). It is to be appreciated that a passively controlled biasing mechanism may be placed in a different orientation, according to an embodiment, but for simplicity of the design, the vertical orientation may be preferred. In a vertical orientation, the intermediate discharge port 175A can move radially (e.g., about perpendicular to the rotors 105, 110) from or toward the compression chamber 145.

When the screw compressor 100 is operating at a lower pressure ratio than designed (e.g., a part-load operation), the intermediate discharge port 175A can be in the flow-permitted state (FIG. 4). In such an operating condition, the pressure of the discharge is lower than the pressure in the compression chamber 145. Accordingly, the pressurized fluid can force the sealing member 185 in the d1 direction (vertically upward), enabling flow of the working fluid from the compression chamber 145 through the intermediate discharge port 175A. When the compressor is operating at its designed pressure ratio (e.g., full-load operation) the pressure of the working fluid at the discharge may be higher than the pressure of the working fluid in the compression chamber 145. As a result, the sealing member 185 may be forced in the d2 direction (vertically downward), thereby causing the sealing member 185 to be in sealing contact with the surface 190A, thereby preventing flow through the intermediate discharge port 175A. In such an operating condition, the fluid being compressed can be discharged through the outlet port 140.

The biasing mechanism 180 is connected to the sealing member 185 such that the biasing mechanism 180 can move the sealing member 185 in either a direction d1 (vertically up with respect to the page in the figures) or a direction d2 (vertically down with respect to the page in the figures). The sealing member 185 can include a surface 185A which can serve as a sealing surface in a flow-blocked state. That is, the surface 185A can form a sealing engagement with a sealing surface 190A of the chamber 190 when in the flow-blocked state (FIG. 3). In the flow-blocked state (FIG. 3), the surface 185A of the sealing member 185 can prevent a fluid (e.g., working fluid such as a heat transfer fluid, etc.) from radially exiting the compression chamber 145.

The chamber 190 can be sized to permit the sealing member 185 to translate in the d1 and d2 directions. The chamber 190 can be in fluid communication with a discharge of the screw compressor 100 when the intermediate discharge port 175A is in the flow-permitted state (FIG. 4). The plurality of apertures 195 is disposed within the housing 115. In an embodiment, the plurality of apertures 195 is bored into the housing 115. When in the flow-permitted state (FIG. 4), the plurality of apertures 195 is fluidly connected with the chamber 190, and accordingly with the discharge of the screw compressor 100. When in the flow-blocked state (FIG. 3), the plurality of apertures 195 is fluidly sealed from the chamber 190 by a sealing engagement between the surface 185A of the sealing member 185 and the sealing surface 190A of the chamber 190.

In the illustrated embodiment, three apertures 195 are shown. It will be appreciated that the number of apertures 195 is an example. The intermediate discharge port 175A can include more than three apertures 195, according to an embodiment, or fewer than three apertures 195, according to an embodiment. For example, in an embodiment, the intermediate discharge port 175A can include four apertures 195, with two apertures being disposed in each bore 120A, 120B of the screw compressor 100 such that symmetry is maintained between each of the bores 120A, 120B. The apertures 195 can be based on a size of the bore 120A, 120B. Generally, a number of apertures 195 may be limited based on, for example, manufacturing limitations.

The size and geometry of the plurality of apertures 195 can be determined based on, for example, simplicity of manufacturing, flow rate of the working fluid, or the like. In an embodiment, a distance L1 from an inlet of the plurality of apertures 195 to an outlet of the plurality of apertures into the chamber 190 can be determined by, for example, manufacturing tolerances or the like. Additionally, the distance L1 can be selected to minimize an amount of the working fluid which may enter the plurality of apertures 195 when the intermediate discharge port 175 is in the flow-blocked state (FIG. 3).

Figure 5:
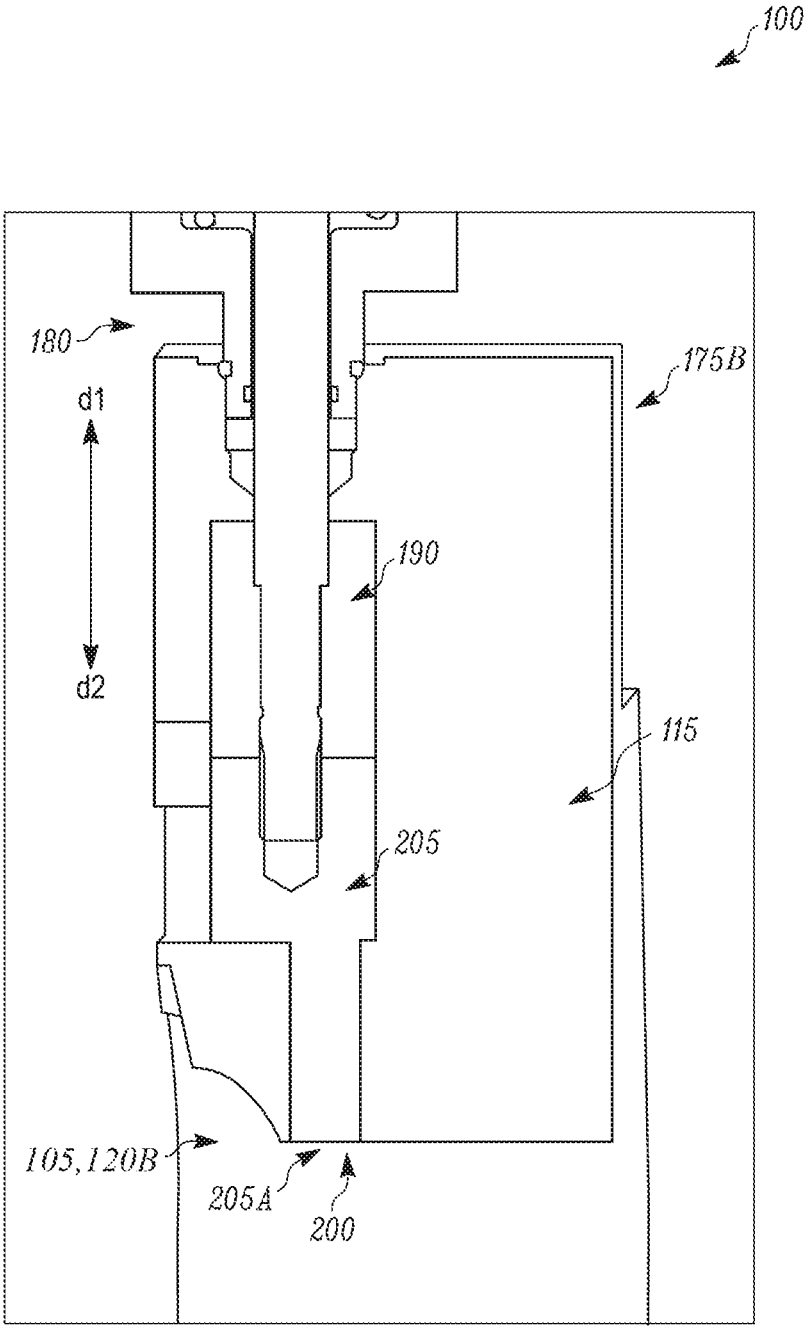
FIG. 5 illustrates a screw compressor including an intermediate discharge port in a flow-blocked state, according to another embodiment.
Figure 6:
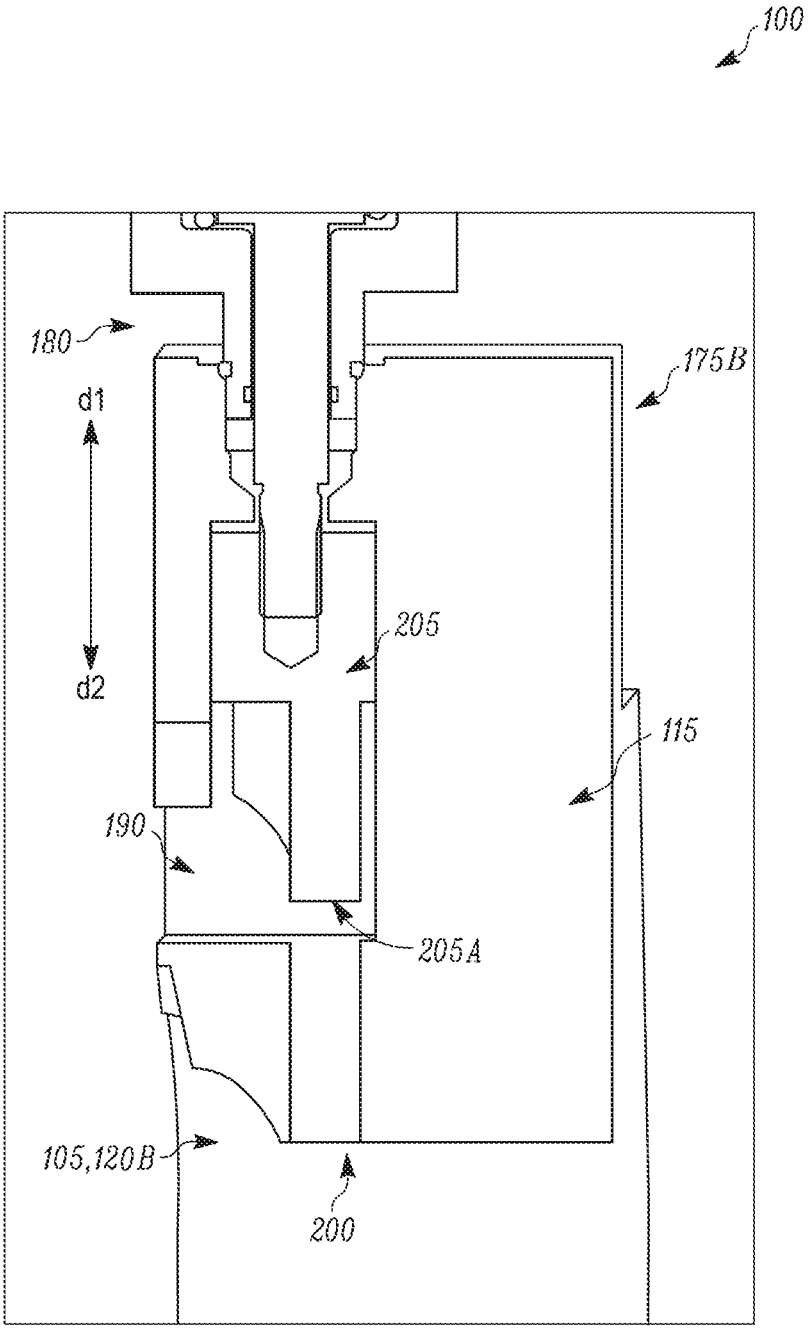
FIG. 6 illustrates the screw compressor including the intermediate discharge port of FIG. 5 in a flow-permitted state, according to another embodiment.
Figure 7:
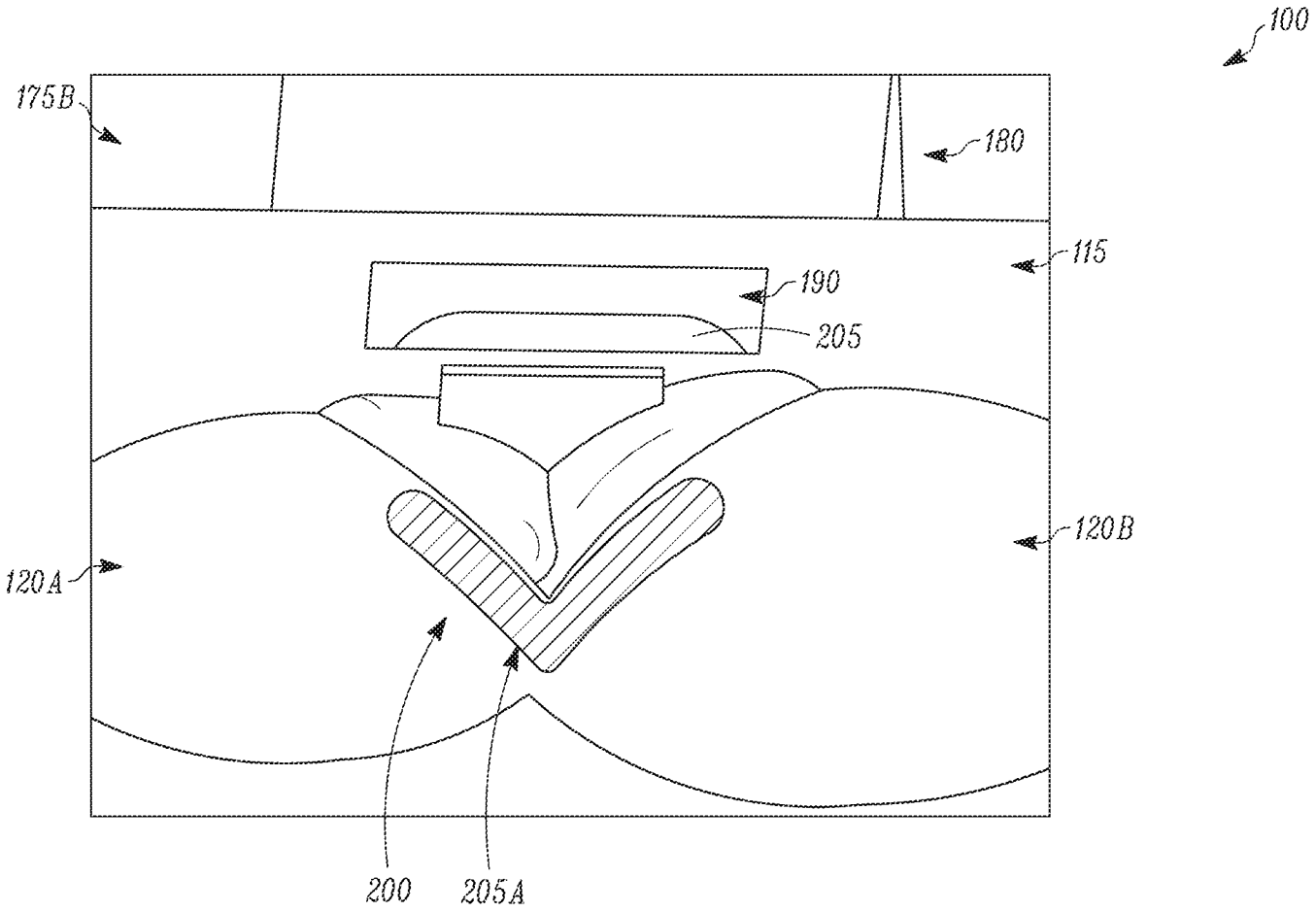
FIG. 7 illustrates another view of the screw compressor including the intermediate discharge port of FIG. 5 in the flow-blocked state, according to another embodiment.

FIG. 5 illustrates the screw compressor 100 including an intermediate discharge port 175B, according to an embodiment. In FIG. 5, the intermediate discharge port 175B is in the flow-blocked state. FIG. 6 illustrates the screw compressor 100 including the intermediate discharge port 175B of FIG. 5, according to an embodiment. In FIG. 6, the intermediate discharge port 175B is in the flow-permitted state. FIG. 7 illustrates an alternative view of the screw compressor 100 including the intermediate discharge port 175B of FIG. 5 in the flow-blocked state. FIGS. 5-7 will be described generally, unless specific reference is made to the contrary.

Aspects of the intermediate discharge port 175B in FIGS. 5-7 are the same as or similar to aspects of the intermediate discharge port 175A in FIGS. 3-4. To simplify this specification, aspects of FIGS. 5-7 which are different from aspects of FIGS. 3-4 will be discussed, while aspects which are the same or substantially similar will not be described in additional detail.

The intermediate discharge port 175B includes a single aperture 200, according to an embodiment. The single aperture 200 functions similarly to the plurality of apertures 195 in the embodiment shown and described above with respect to FIGS. 3-4. The aperture 200 can follow a contour of the bores 120A and 120B of the housing 115 (see FIG. 7). A portion of the aperture 200 is in the bore 120A and another portion of the aperture 200 is in the second bore 120B. Accordingly, the aperture 200 can be approximately shaped to match a rotor-helix angle of the screw compressor 100. In an embodiment, the aperture 200 can be approximately v-shaped. A sealing member 205 is configured to include a surface 205A which follows a contour of the bores 120A, 120B as well (FIG. 7). Accordingly, the sealing member 205 can be approximately v-shaped to correspond to the aperture 200, according to an embodiment.

When the intermediate discharge port 175B is in the flow-blocked state (FIG. 5), the surface 205A approximately follows the contour of the bores 120A, 120B of the housing 115. Accordingly, when the intermediate discharge port 175B is in the flow-blocked state (FIG. 5), the bores 120A, 120B and the housing 115 may be substantially smooth. The intermediate discharge port 175B and corresponding shape can, for example, prevent portions of the working fluid being compressed from entering the aperture 200 when in the flow-blocked state (FIG. 5). That is, relative to the embodiment in FIGS. 3-4, which includes a distance L1 between the bores 120A, 120B and the sealing member 185 in a flow-blocked state (FIG. 3), the embodiment in FIGS. 5-6 does not include (or reduces) an area in which the working fluid being compressed can be directed when in the flow-blocked state. When the intermediate discharge port 175B is in the flow-permitted state (FIG. 6), the compression chamber 145, the aperture 200, and the discharge are fluidly connected such that the working fluid can be discharged from the intermediate discharge port 175B.

Aspects:

It is to be appreciated that any one of aspects 1-8 can be combined with any one of aspects 9-18 or any one of aspects 19-20. Any one of aspects 9-18 can be combined with any one of aspects 19-20.

Aspect 1. A screw compressor, comprising:

a compressor housing defining a working chamber, the housing including a plurality of bores;

a first rotor having helical threads, the first rotor being housed in a first of the plurality of bores;

a second rotor having helical threads intermeshing with the helical threads of the first rotor, the second rotor being housed in a second of the plurality of bores;

an inlet port that receives a fluid to be compressed;

an outlet port that receives a compressed fluid; and an intermediate discharge port disposed between the compression chamber and the outlet port, the intermediate discharge port including a sealing member and a biasing mechanism, fluid flow being prevented between the compression chamber and the intermediate discharge port when in a flow-blocked state, and fluid flow being enabled from the compression chamber through the intermediate discharge port when in a flow-permitted state.

Aspect 2. The screw compressor according to aspect 1, wherein the intermediate discharge port is disposed at a location of the compression chamber at which a fluid being compressed is partially compressed.

Aspect 3. The screw compressor according to any one of aspects 1-2, wherein the screw compressor includes a plurality of intermediate discharge ports disposed between the inlet port and the outlet port.

Aspect 4. The screw compressor according to any one of aspects 1-3, wherein the biasing mechanism is electrically connected to a controller for selectively placing the intermediate discharge port in the flow-blocked state or the flow-permitted state.

Aspect 5. The screw compressor according to any one of aspects 1-3, wherein the biasing mechanism is passively controlled based on a pressure ratio between the fluid in the working chamber and the compressed fluid at the outlet port.

Aspect 6. The screw compressor according to any one of aspects 1-5, wherein the compressor housing includes a plurality of apertures configured to fluidly connect the compression chamber and the intermediate discharge port when in the flow-permitted state.

Aspect 7. The screw compressor according to any one of aspects 1-5, wherein the compressor housing includes a single aperture configured to fluidly connect the compression chamber and the intermediate discharge port when in the flow-permitted state.

Aspect 8. The screw compressor according to aspect 7, wherein the single aperture is formed in a wall of the housing, a portion of the aperture being in the first of the plurality of bores and another portion of the aperture being in the second of the plurality of bores.

Aspect 9. A heating, ventilation, and air conditioning (HVAC) system, comprising:

a condenser, an expansion device, and an evaporator, and a screw compressor fluidly connected and forming a heat transfer circuit, wherein the screw compressor includes:

a compressor housing defining a working chamber, the housing including two bores;

a first rotor having helical threads, the first rotor being housed in a first of the two bores;

a second rotor having helical threads intermeshing with the helical threads of the first rotor, the second rotor being housed in a second of the two bores;

a suction port that receives a fluid to be compressed;

an outlet port that receives a compressed fluid; and an intermediate discharge port disposed between the compression chamber and the outlet port, the intermediate discharge port including a sealing member and a biasing mechanism, fluid flow being prevented between the compression chamber and the intermediate discharge port when in a flow-blocked state, and fluid flow being enabled from the compression chamber through the intermediate discharge port when in a flow-permitted state.

Aspect 10. The HVAC system according to aspect 9, further comprising a controller electrically connected to the biasing mechanism that selectively controls the intermediate discharge port such that the intermediate discharge port is placed in the flow-blocked or the flow-permitted state.

Aspect 11. The HVAC system according to aspect 9, wherein the biasing mechanism is passively controlled based on a pressure ratio between the fluid in the working chamber and the compressed fluid at the discharge port.

Aspect 12. The HVAC system according to any one of aspects 9-11, wherein the intermediate discharge port is in the flow-blocked state when the screw compressor is operating at a full-load.

Aspect 13. The HVAC system according to any one of aspects 9-12, wherein the intermediate discharge port is in the flow-permitted state when the screw compressor is operating at a partial load.

Aspect 14. The HVAC system according to any one of aspects 9-12, wherein the intermediate discharge port is disposed at a location of the compression chamber at which a fluid being compressed is partially compressed.

Aspect 15. The HVAC system according to any one of aspects 9-14, wherein the screw compressor includes a plurality of intermediate discharge ports disposed between the inlet port and the outlet port.

Aspect 16. The HVAC system according to any one of aspects 9-15, wherein the compressor housing includes a plurality of apertures configured to fluidly connect the compression chamber and the intermediate discharge port when in the flow-permitted state.

Aspect 17. The HVAC system according to any one of aspects 9-16, wherein the compressor housing includes a single aperture configured to fluidly connect the compression chamber and the intermediate discharge port when in the flow-permitted state.

Aspect 18. The HVAC system according to aspect 17, wherein the single aperture is formed in a wall of the housing, a portion of the aperture being in the first of the plurality of bores and another portion of the aperture being in the second of the plurality of bores.

Aspect 19. A method, comprising:

providing an intermediate discharge port at a location in fluid communication with a compression chamber of a screw compressor, the intermediate discharge port being disposed between an inlet port and an outlet port of the screw compressor, wherein when operating the screw compressor at part-load, discharging a portion of a working fluid being compressed from the compression chamber toward a discharge of the screw compressor, the working fluid being at a pressure that is lower than a discharge pressure of the screw compressor, and when operating the screw compressor at full-load, discharging the working fluid being compressed from the outlet port of the screw compressor.

Aspect 20. The method according to aspect 19, wherein the providing includes retrofitting the intermediate discharge port into the screw compressor following manufacturing.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

The invention claimed is:

1. A screw compressor, comprising:

a compressor housing defining a working chamber, the housing including a plurality of bores;

a first rotor having helical threads, the first rotor being housed in a first of the plurality of bores;

a second rotor having helical threads intermeshing with the helical threads of the first rotor, the second rotor being housed in a second of the plurality of bores;

an inlet suction port that receives a fluid to be compressed;

an outlet discharge port that receives a compressed fluid;

a compression chamber formed by the intermeshing of the helical threads of the first rotor and the helical threads of the second rotor between the inlet suction port and the outlet discharge port; and an intermediate discharge port fluidly connectable to the compression chamber and disposed between the inlet suction port and the outlet discharge port and spaced from the outlet discharge port, the intermediate discharge port being disposed at a top portion of the compressor housing so that a piston included in the intermediate discharge port is fluid-forced vertically upward or downward to selectively transition the intermediate discharge port between a flow-blocked state and a flow-permitted state, based on an operating pressure ratio of the compressor, the operating pressure ratio between fluid in the compression chamber and the compressed fluid at the outlet discharge port, the intermediate discharge port including a sealing member having a sealing surface that follows a contour of the first bore and the second bore and forms a sealing engagement with a surface within the intermediate discharge port when biased by the piston to be in the flow-blocked state so that fluid flow is prevented between the compression chamber and the intermediate discharge port when in the flow-blocked state, and fluid flow being enabled from the compression chamber through the intermediate discharge port when biased by the piston to be in the flow-permitted state in which the sealing surface is disengaged from sealing engagement with the surface within the intermediate discharge port, the sealing surface being disposed at a first vertical distance from the compression chamber when in the flow-blocked state and a second vertical distance from the compression chamber when in the flow permitted state, the first vertical distance being relatively smaller than the second vertical distance.

2. The screw compressor according to claim 1, wherein the intermediate discharge port is disposed at a location of the compression chamber at which a fluid being compressed is partially compressed.

3. The screw compressor according to claim 1, wherein the screw compressor includes a plurality of intermediate discharge ports disposed between the inlet suction port and the outlet discharge port, the plurality of intermediate discharge ports being disposed at different locations along the compression chamber between the inlet suction port and the outlet discharge port.

4. The screw compressor according to claim 1, wherein the compressor housing includes a plurality of apertures configured to fluidly connect the compression chamber and the intermediate discharge port when in the flow-permitted state.

5. The screw compressor according to claim 1, wherein the compressor housing includes a single aperture configured to fluidly connect the compression chamber and the intermediate discharge port when in the flow-permitted state.

6. The screw compressor according to claim 5, wherein the single aperture is formed in a wall of the housing, a portion of the single aperture being in the first of the plurality of bores and another portion of the single aperture being in the second of the plurality of bores.

7. A heating, ventilation, and air conditioning (HVAC) system, comprising:

a condenser, an expansion device, and an evaporator, and a screw compressor fluidly connected and forming a heat transfer circuit, wherein the screw compressor includes:

a compressor housing defining a working chamber, the housing including two bores;

a first rotor having helical threads, the first rotor being housed in a first of the two bores;

a second rotor having helical threads intermeshing with the helical threads of the first rotor, the second rotor being housed in a second of the two bores;

an inlet suction port that receives a fluid to be compressed;

an outlet discharge port that receives a compressed fluid;

a compression chamber formed by the intermeshing of the helical threads of the first rotor and the helical threads of the second rotor between the inlet suction port and the outlet discharge port; and an intermediate discharge port fluidly connectable to the compression chamber and disposed between the inlet suction port and the outlet discharge port and spaced from the outlet discharge port, the intermediate discharge port being disposed at a top portion of the compressor housing so that a piston included in the intermediate discharge port is fluid-forced vertically upward or downward to selectively transition the intermediate discharge port between a flow-blocked state and a flow-permitted state, based on an operating pressure ratio of the compressor, the operating pressure ratio between fluid in the compression chamber and the compressed fluid at the outlet discharge port, the intermediate discharge port including a sealing member having a sealing surface that follows a contour of the first bore and the second bore and forms a sealing engagement with a surface within the intermediate discharge port when biased by the piston to be in the flow-blocked state so that fluid flow is prevented between the compression chamber and the intermediate discharge port when in the flow-blocked state, and fluid flow being enabled from the compression chamber through the intermediate discharge port when biased by the piston to be in the flow-permitted state in which the sealing surface is disengaged from sealing engagement with the surface within the intermediate discharge port, the sealing surface being disposed at a first vertical distance from the compression chamber when in the flow-blocked state and a second vertical distance from the compression chamber when in the flow-enabled state, the first vertical distance being relatively smaller than the second vertical distance.

8. The HVAC system according to claim 7, wherein the piston of the intermediate discharge port is controlled based on a pressure ratio between a fluid in the compression chamber and the compressed fluid at the outlet discharge port.

9. The HVAC system according to claim 7, wherein the intermediate discharge port is in the flow-blocked state when the screw compressor is operating at a full-load.

10. The HVAC system according to claim 7, wherein the intermediate discharge port is in the flow-permitted state when the screw compressor is operating at a partial load.

11. The HVAC system according to claim 7, wherein the intermediate discharge port is disposed at a location of the compression chamber at which a fluid being compressed is partially compressed.

12. The HVAC system according to claim 7, wherein the screw compressor includes a plurality of intermediate discharge ports disposed between the inlet suction port and the outlet discharge port, the plurality of intermediate discharge ports being disposed at different locations along the compression chamber between the inlet suction port and the outlet discharge port.

13. The HVAC system according to claim 7, wherein the compressor housing includes a plurality of apertures configured to fluidly connect the compression chamber and the intermediate discharge port when in the flow-permitted state.

14. The HVAC system according to claim 7, wherein the compressor housing includes a single aperture configured to fluidly connect the compression chamber and the intermediate discharge port when in the flow-permitted state.

15. The HVAC system according to claim 14, wherein the single aperture is formed in a wall of the housing, a portion of the single aperture being in the first of the plurality of bores and another portion of the single aperture being in the second of the plurality of bores.

16. A method, comprising:

providing an intermediate discharge port at a location in fluid communication with a compression chamber of a screw compressor, the intermediate discharge port being disposed between an inlet suction port and an outlet discharge port of the screw compressor and spaced from the outlet discharge port, the intermediate discharge port being disposed at a top portion of a compressor housing of the screw compressor so that a piston included in the intermediate discharge port is fluid-forced vertically upward or downward to selectively transition the intermediate discharge port between a flow-blocked state and a flow-permitted state, based on an operating pressure ratio of the compressor, the operating pressure ratio between fluid in the compression chamber and the compressed fluid at the outlet discharge port, wherein when operating the screw compressor at part-load, discharging a portion of a working fluid being compressed from the compression chamber toward a discharge of the screw compressor, the working fluid being at a pressure that is lower than a discharge pressure of the screw compressor, and when operating the screw compressor at full-load, discharging the working fluid being compressed from the outlet discharge port of the screw compressor.

17. The method according to claim 16, wherein the providing includes retrofitting the intermediate discharge port into the screw compressor following manufacturing.

18. A screw compressor, comprising:

a compressor housing defining a working chamber, the housing including a plurality of bores;

a first rotor having helical threads, the first rotor being housed in a first of the plurality of bores;

a second rotor having helical threads intermeshing with the helical threads of the first rotor, the second rotor being housed in a second of the plurality of bores;

an inlet suction port that receives a fluid to be compressed;

an outlet discharge port that receives a compressed fluid;

a compression chamber formed by the intermeshing of the helical threads of the first rotor and the helical threads of the second rotor between the inlet suction port and the outlet discharge port; and an intermediate discharge port fluidly connectable to the compression chamber and disposed between the inlet suction port and the outlet discharge port and spaced from the outlet discharge port, the intermediate discharge port being disposed at a top portion of the compressor housing so that a piston included in the intermediate discharge port is fluid-forced vertically upward or downward to selectively transition the intermediate discharge port between a flow-blocked state and a flow-permitted state, based on an operating pressure ratio of the compressor, the operating pressure ratio between fluid in the compression chamber and the compressed fluid at the outlet discharge port, the intermediate discharge port is passively controlled by the piston based on a pressure ratio between a fluid in the compression chamber and the compressed fluid at the output discharge port to place the intermediate discharge port in the flow-blocked state or the flow-permitted state, the intermediate discharge port including a sealing member having a sealing surface that follows a contour of the bores and forms a sealing engagement with a surface within the intermediate discharge port when biased by the piston to be in the flow-blocked state so that fluid flow is prevented between the compression chamber and the intermediate discharge port when in the flow-blocked state, and fluid flow being enabled from the compression chamber through the intermediate discharge port when biased by the piston to be in the flow-permitted state in which the sealing surface is disengaged from sealing engagement with the surface within the intermediate discharge port, the sealing surface being disposed at a first vertical distance from the compression chamber when in the flow-blocked state and a second vertical distance from the compression chamber when in the flow permitted state, the first vertical distance being relatively smaller than the second vertical distance.

19. A heating, ventilation, and air conditioning (HVAC) system having the screw compressor of claim 18, the system comprising:

a condenser, an expansion device, an evaporator, and the screw compressor of claim 18 fluidly connected and forming a heat transfer circuit.

* * * * *